US007739945B2

(12) United States Patent
Bianchi

(10) Patent No.: US 7,739,945 B2
(45) Date of Patent: Jun. 22, 2010

(54) BENT AXIS PUMP

(75) Inventor: Amedeo Bianchi, Brescja (IT)

(73) Assignee: OMFB S.p.A. Hydraulic Components, Provaglio D'Iseo, Brescia (IT)

( * ) Notice: Subject to any disclaimer, the term of this patent is extended or adjusted under 35 U.S.C. 154(b) by 229 days.

(21) Appl. No.: 12/144,206

(22) Filed: Jun. 23, 2008

(65) Prior Publication Data

US 2009/0013863 A1 Jan. 15, 2009

Related U.S. Application Data

(63) Continuation of application No. PCT/IT2007/000678, filed on Sep. 27, 2007.

(30) Foreign Application Priority Data

Jul. 12, 2007 (IT) ..... BS2007A0094

(51) Int. Cl.
*F04B 1/20* (2006.01)
*F04B 27/08* (2006.01)

(52) U.S. Cl. ..... 92/57; 92/12.2

(58) Field of Classification Search ..... 91/499; 92/12.2, 57

See application file for complete search history.

(56) References Cited

U.S. PATENT DOCUMENTS

| | | | | |
|---|---|---|---|---|
| 2,177,008 | A * | 10/1939 | Snader et al. | 91/499 |
| 4,012,994 | A * | 3/1977 | Malmros | 92/57 |
| 4,664,018 | A * | 5/1987 | Eickmann | 92/57 |
| 4,788,902 | A | 12/1988 | Akasaka et al. | |
| 6,336,391 | B1 * | 1/2002 | Alm et al. | 92/57 |

FOREIGN PATENT DOCUMENTS

| | | |
|---|---|---|
| DE | 100 44 785 | 4/2002 |
| EP | 0 567 805 A1 | 11/1993 |

OTHER PUBLICATIONS

International Search Report and Written Opinion of the International Searching Authority for International Patent Application No. PCT/IT2007/000678 dated Apr. 7, 2008.

* cited by examiner

*Primary Examiner*—Thomas E Lazo
(74) *Attorney, Agent, or Firm*—Kilyk & Bowersox, P.L.L.C.

(57) ABSTRACT

A bent axis pump wherein the coupling between a cylinder body and a connecting pin of a back body takes place by the interposition of a bush suitable for guiding the rotation of the cylinder body limiting the friction between the cylinder body and the pin. The pin life is considerably extended.

19 Claims, 5 Drawing Sheets

BENT AXIS PUMP

This application is a continuation of International Patent Application No. PCT/IT2007/000678, filed Sep. 27, 2007, which in turn claims priority to Italian Patent Application No. BS2007A000094, filed Jul. 12, 2007, and are incorporated in their entirety by reference herein.

FIELD OF THE INVENTION

The present invention relates to a bent axis pump and method of assembly of a bent axis pump.

BACKGROUND OF THE INVENTION

Bent axis pumps usually comprise a front body having a revolving shaft operatively connected to pistons for the pump suction and delivery, and a back fixed body that comprises the pump suction and delivery channels.

A central revolving body or cylinder body, integral in rotation with the shaft, is inserted between the front body and the back body. The central body comprises the cylinders suitable for seating the pistons.

The central body is inclined relative to the front body, so that the sliding axis of the pistons is bent relative to the axis of rotation of the front body.

The shaft of the front body is integral with the pistons so as to transmit the rotation motion thereto.

The inclination between the axis of rotation of the front body determines the alternating motion of the pistons relative to the cylinders following the rotation of pistons relative to the axis of rotation of the front body.

The central body is associated to the back fixed body by a pin integral with the back body.

Thus, a fixing portion of the pin is integrally constrained to the back body whereas a guiding portion of the pin couples with a relative seat of the central body. Such guiding portion has the function of being a guide for the rotation of the central body and is subject to a friction action by the pin itself.

The coupling between pin and central body is a critical point of the pump.

In fact, even slight shifts between the pin and the central body generate such stresses as to quickly cause the breakage of the pin.

To obviate such disadvantage, in the art it is known to strengthen the pin also through the application of coating materials and increase the lubrication between the pin and the central body seat. Nevertheless, breakage phenomena are not prevented and the pin life is quite limited.

SUMMARY OF THE INVENTION

The problem of the present invention is to provide a pump which should solve the disadvantages mentioned with reference to the prior art.

Such disadvantages and restrictions are solved by a pump in accordance with claim 1 and by a method in accordance with claim 14.

BRIEF DESCRIPTION OF THE DRAWINGS

Other embodiments of the pump according to the invention are described in the subsequent claims.

Further features and the advantages of the present invention will appear more clearly from the following description of preferred non-limiting embodiments thereof, wherein.

DETAILED DESCRIPTION OF THE INVENTION

Figure 1:
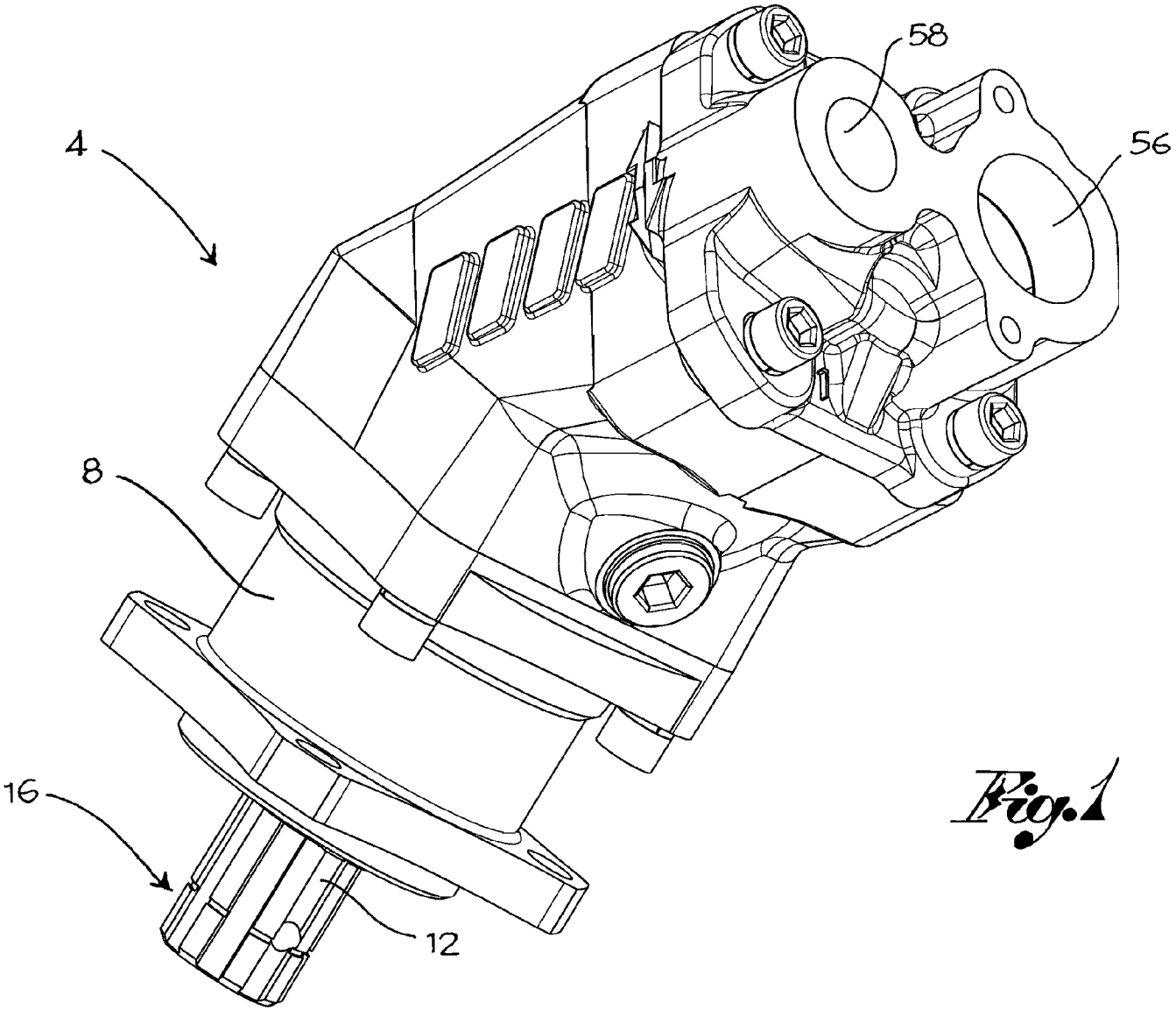
FIG. 1 shows a perspective view of a bent axis pump according to an embodiment of the present invention.

Elements or parts of elements in common between the embodiments described below are referred to with the same reference numerals.

With reference to the above figures, reference numeral 4 globally denotes a bent axis pump.

In particular, pump 4 comprises a fixed front body 8, for example of cast iron, provided with a shaft 12 revolving relative to a first axis of rotation X-X, turnably supported on bearings 14.

Shaft 12 comprises a grooved end 16, for receiving a driving torque and opposite said grooved end 16, spherical seats 18.

The front body 8 and shaft 12 are arranged parallel to the first axis of rotation X-X.

Shaft 12 is integral with a toothed rim 20, for example constrained to the shaft, on the side of the spherical seats 18, by the interposition of a pin 22.

Shaft 12 is operatively connected to pistons 26, engaged at an end in the spherical seats 18 of the shaft, and at an opposite end provided with elastic bands 28.

Pump 4 further comprises a cylinder body 32 associated to shaft 12 of the front body 8 and comprising cylinders 34 suitable for seating and guiding said pistons 26.

The cylinder body 32 is arranged along a second axis of rotation Y-Y bent relative to the first axis of rotation X-X according to a bending angle, for example equal to 40 degrees.

The cylinder body 32 comprises a conical toothing 38 suitable for engaging with the toothed rim 20 of shaft 12 so as to receive the rotation motion from shaft 12, thus the cylinder body 32 is integral in rotation with shaft 12 of the front body 8.

The cylinder body 32 comprises a seat 42 preferably coaxial with said second axis of rotation Y-Y.

According to an embodiment, the cylinder body 32 comprises a central pin 44 provided with a pre-load spring 45. The central pin 44 is at least partly inserted in seat 42 and is operatively connected to shaft 12. The pre-load spring 45 has the function of exerting a pre-load on the cylinder body 32 avoiding phenomena of lifting of the cylinder body 32 in the idle operation of pump 4.

The central pin 44 preferably comprises a collar 46 that abuts on a shoulder 48 obtained inside seat 42; in this way the action of spring 45 tends to move the cylinder body 32 away from the front body 8.

Pump 4 further comprises a back body 54 associated to the cylinder body 32 and comprising a suction duct 56 and a delivery duct 58 for said pistons 26.

The fixed back body 54 is associated to the cylinder body 32 by the interposition of a connecting pin 62. Said connecting pin 62 is integral with the back body 54. For example the connecting pin is inserted with interference in a blind hole 64 of the back body 54, so as to exhibit a guiding portion 68 that protrudes from said blind hole 64.

Preferably the guiding portion 68 exhibits at least one levelling 72 suitable for determining a meatus between the pin and seat 42 so as to allow the passage of lubricant between pin 62 and seat 42.

Seat 42 is suitable for receiving the guiding portion 68 of connecting pin 62; preferably, seat 42 is at least partly counter shaped relative to said guiding portion 68; in other words both the seat and the guiding portion have a cylindrical configuration and are coaxial relative to the second axis of rotation Y-Y.

Advantageously, the cylinder body 32 comprises at least one bush 76 inserted in seat 42 and integral therewith. Bush 76 is suitable for turnably receiving the guiding portion 68 of pin 62; it should be noted that the guiding portion 68 is fixed while bush 76 is driven in rotation by the cylinder body 32 it is integral with and rotating, it slides on the outer surface of the guiding portion 68.

Preferably, bush 76 is inserted and locked by interference in seat 42 of the cylinder body 32.

According to an embodiment, bush 76 exhibits a metal portion 78 in contact with an inner wall 80 of said seat.

Figure 10:
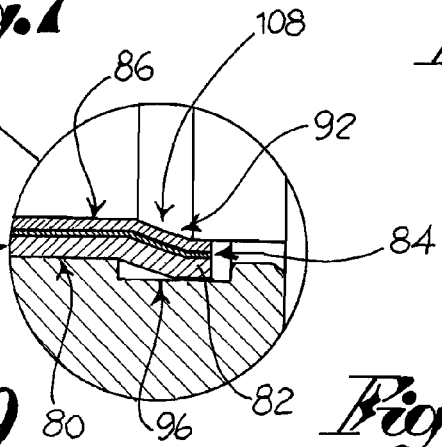
FIG. 10 shows a section view of the enlarged detail X of FIG. 9.

Preferably the metal portion 78 is bimetallic and comprises a first contact portion 82, suitable for being placed directly in contact with the inner side wall 80 of seat 42 and an interface portion 84, arranged opposite seat 42; the interface portion 84 is suitable for receiving a coating portion 86 that receives pin 62 in contact (FIG. 10).

According to a preferred embodiment, the contact portion 82 is of steel and said interface portion 84 is of porous bronze. Bronze favours the grip of the coating portion 86.

According to an embodiment, the coating portion 86 is made of anti-friction material suitable for receiving the guiding portion 68 of pin 62 in contact.

According to a further embodiment, the coating portion comprises polytetrafluoroethylene (PTFE) and/or polyphenylsulphide (PPS).

The bush is driven with interference in seat 42; preferably, the bush is axially constrained in seat 42 by a stopping wall 88 which forms a shoulder against which the bush itself abuts. By axial direction it is meant a direction parallel to the second axis of rotation Y-Y of the cylinder body 32.

Preferably, bush 76 is axially constrained, opposite the guiding portion 68 of the pin as well as the stopping wall 88 of seat 42, by a tapering 92 suitable for coupling with a flaring 96 obtained on the inlet of seat 42 on the side of the associable back body 54.

Bush 76 may be a single piece or for example two bushes 76 may be inserted in the seat of the cylinder body 32, mechanically separate from each other, axially aligned with each other inside said seat and driven with interference into seat 42, preferably without axial interruption.

The operation of a bent axis pump according to the invention shall now be described.

Pump 4 receives the driving force at the grooved shaft 12 which starts the cylinder body 32 with the relevant pistons 26.

The same relative position is always maintained between the cylinder body 32 and the grooved shaft 12 due to the fact that they are constrained by the coupling between the toothed rim 20 and the conical toothing 38.

Figure 2:
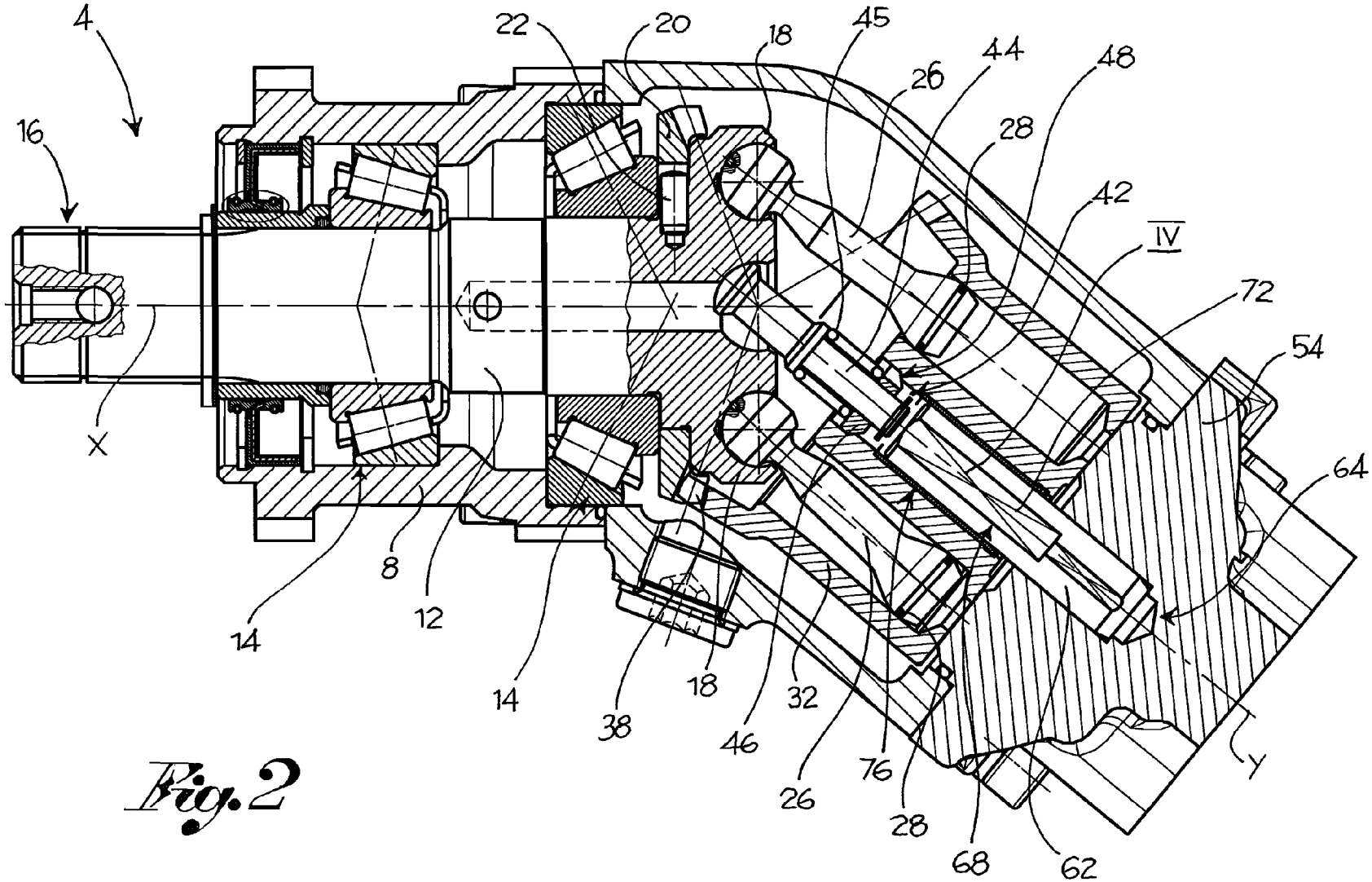
FIG. 2 shows a section view of the pump of FIG. 1.

Since the axes of rotation of shaft 12 and of the cylinder body 32 are inclined with one another by a certain bending angle, for example equal to 40°, in the rotation thereof pistons 26 are forced to make a stroke inside the cylinder body 32 moving from a top dead centre (piston up in FIG. 2) to a bottom dead centre (piston down in FIG. 2) covering a forward stroke and a backward stroke between these two dead centres.

During a full rotation therefore, a piston 26 makes two complete strokes; if for example piston 26 starts from the bottom dead centre, during its forward stroke to the top dead centre it creates a depression zone while during the backward stroke it creates a pressure zone.

During the stroke from the bottom dead centre to the top one, the chamber seating the piston is connected, by the back body 54, to the suction duct 56 and therefore the relevant chamber is called suction chamber.

During the backward stroke the piston chamber is connected, by the back body 54, to the delivery duct 58 and therefore the relevant chamber is called delivery chamber.

Figure 3:
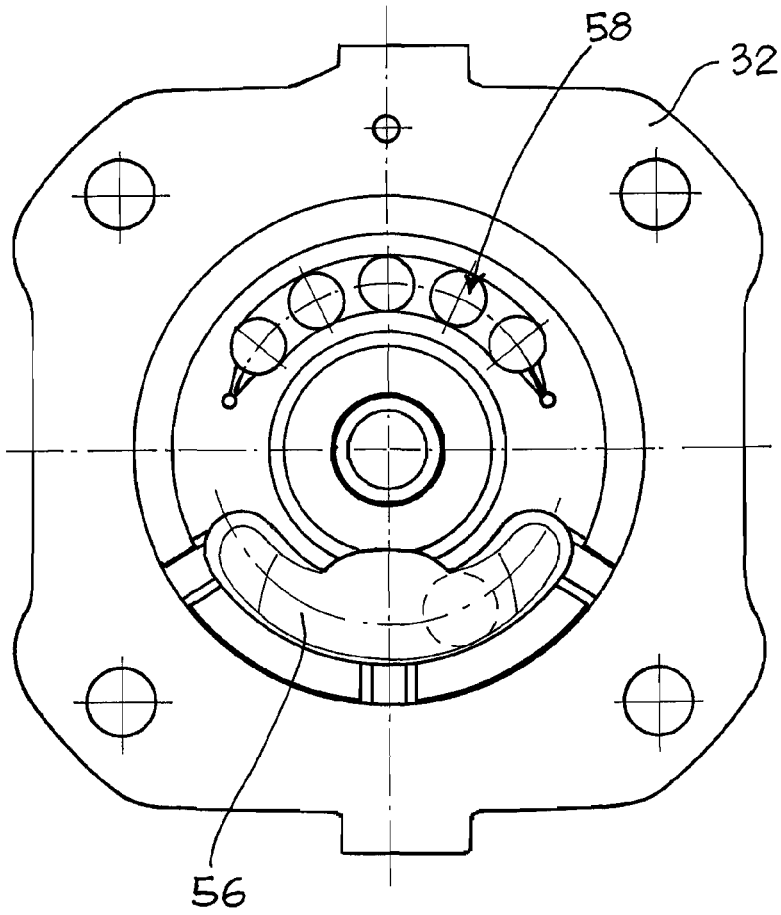
FIG. 3 shows a view of the pump of FIG. 1 from the side of arrow III of FIG. 1, wherein a component of the pump has been removed to show some internal details of the pump.
Figure 4:
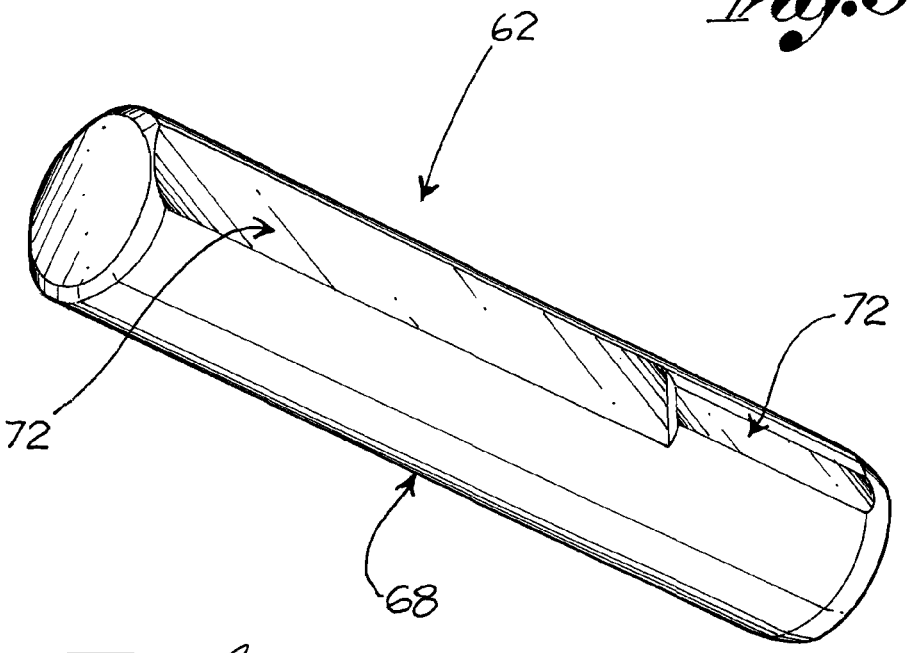
FIG. 4 shows a perspective view of the enlarged detail IV of FIG. 2.

FIG. 3 shows in detail the back body with such section that both the shape and the connection between the suction and delivery chambers are clear.

During the pump rotation the chambers of each piston alternately move on the suction zone (suction step) and on the delivery zone (delivery step) of the back body 54 determining a suction and delivery flow on the average constant in the system.

The pressure at which the pump delivers oil depends on the load applied.

The speed of rotation of the cylinder body may normally reach up to 3000 rpm.

The forces that operate on the pin result from the conical toothing, from the force exerted by the oil pressure from the delivery zone and from the friction of the elastic bands of the pistons.

The lubrication of pin 62 is carried out by levelling 72 on the pin itself that allows the oil to reach pin 62 from the suction zone.

The assembly of a bent axis pump according to the invention shall now be described.

In particular, the assembly of a bent axis pump according to the present invention comprises the steps of applying a guiding head 100 to the back body 54 so as to arrange said head 100 coaxially to the cylinder body 32; the guiding head 100 is provided with a guiding hole 102 coaxial to seat 42 of pin 62.

Figure 5:
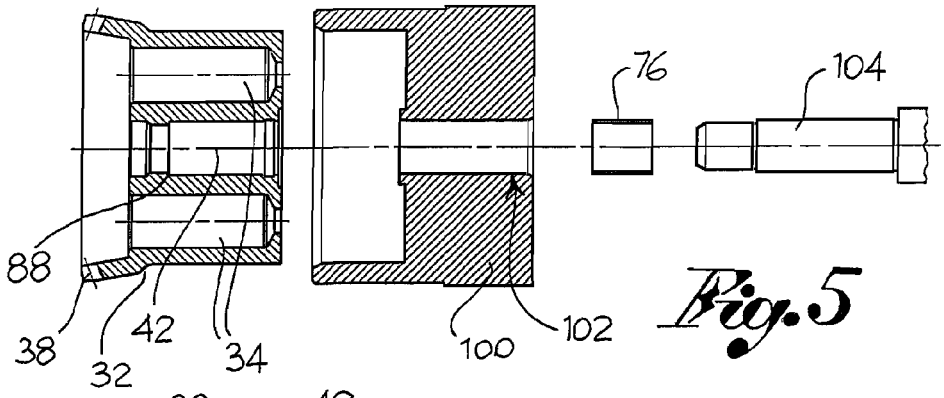
FIGS. 5-9 show section views of subsequent assembly steps of components of the pump of FIG. 1, according to an embodiment of the present invention.
Figure 6:
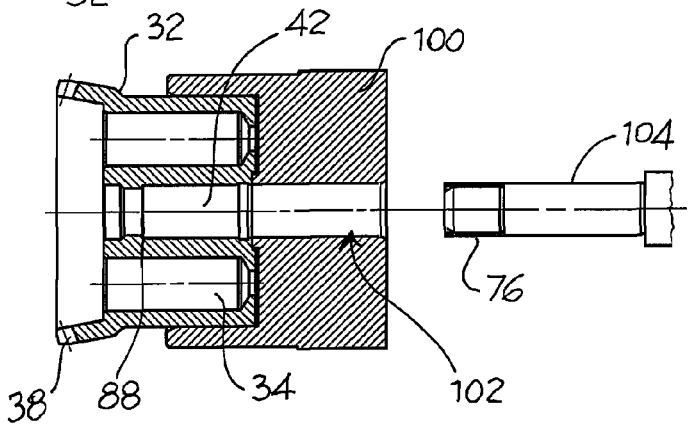

Bush 76 is then inserted in said guiding hole 102 by a punch 104, in other words bush 76 is fitted on punch 104 and the punch with bush 76 is inserted through the guiding hole 102 (FIGS. 5-6).

Figure 7:
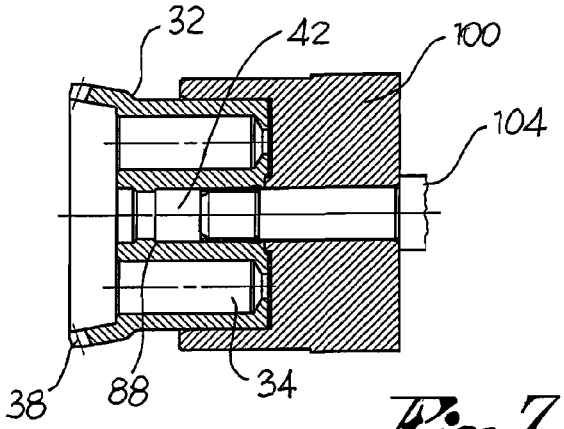
Figure 8:
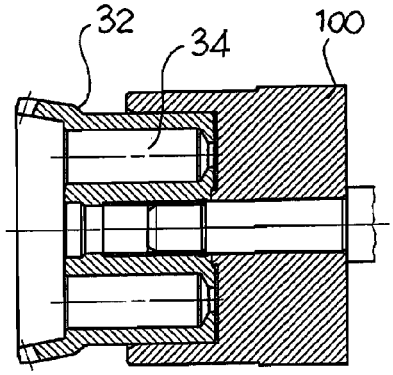

After the axial insertion of the bush by punch 104, bush 76 is moved inside seat 42 of the cylinder body 32 up to move bush 76 to travel end relative to seat 42, preferably abutting on the stopping wall 88 (FIGS. 7-8).

The method preferably comprises the step of axially constraining bush 76 on the side of introduction of pin 62, by making a tapering 92 of bush 76.

Figure 9:
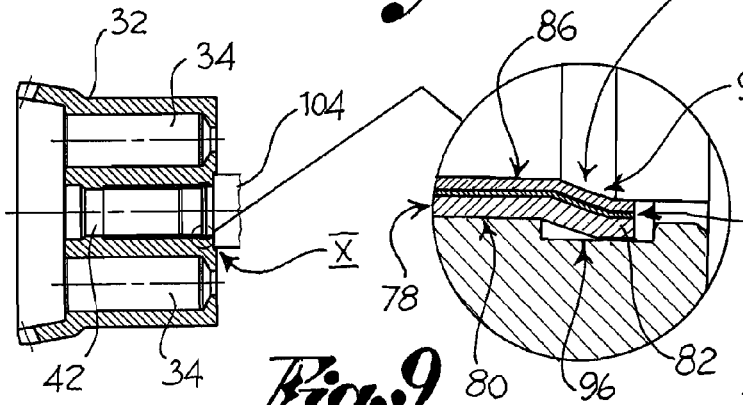

Preferably, the tapering step takes place by the axial insertion to travel end of punch 104; in other words, punch 104 is provided with a neck 108 suitable for enlarging the diameter of said bush 76 so as to enlarge the diameter of the bush at an axial end thereof, up to counter shape the axial end of bush 76 relative to flaring 96 (FIGS. 9-10).

Figure 12:
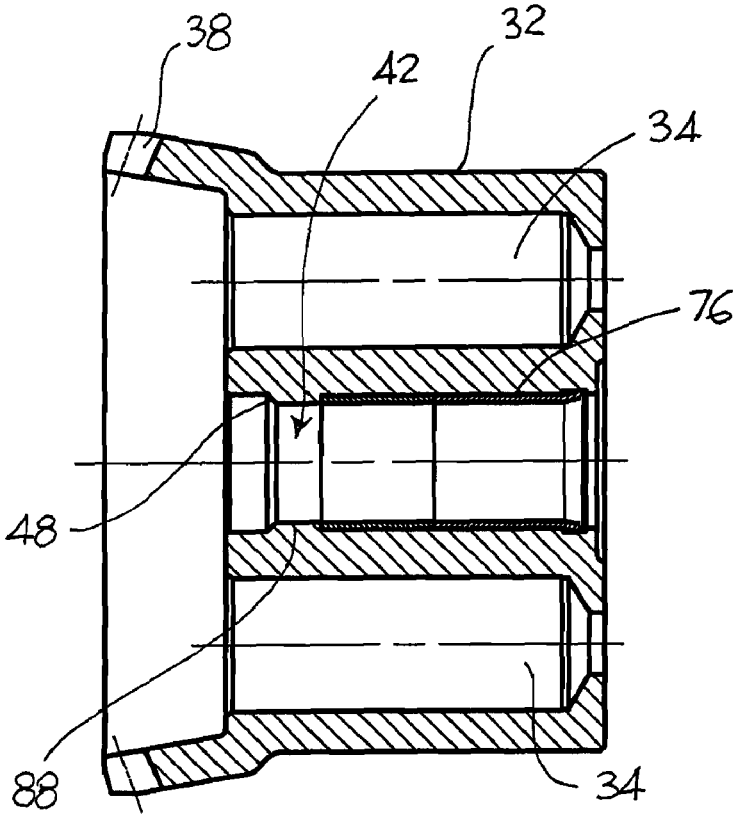
FIGS. 11-12 show section views of subsequent assembly steps of components of the pump of FIG. 1, according to a further embodiment of the present invention.
Figure 11:
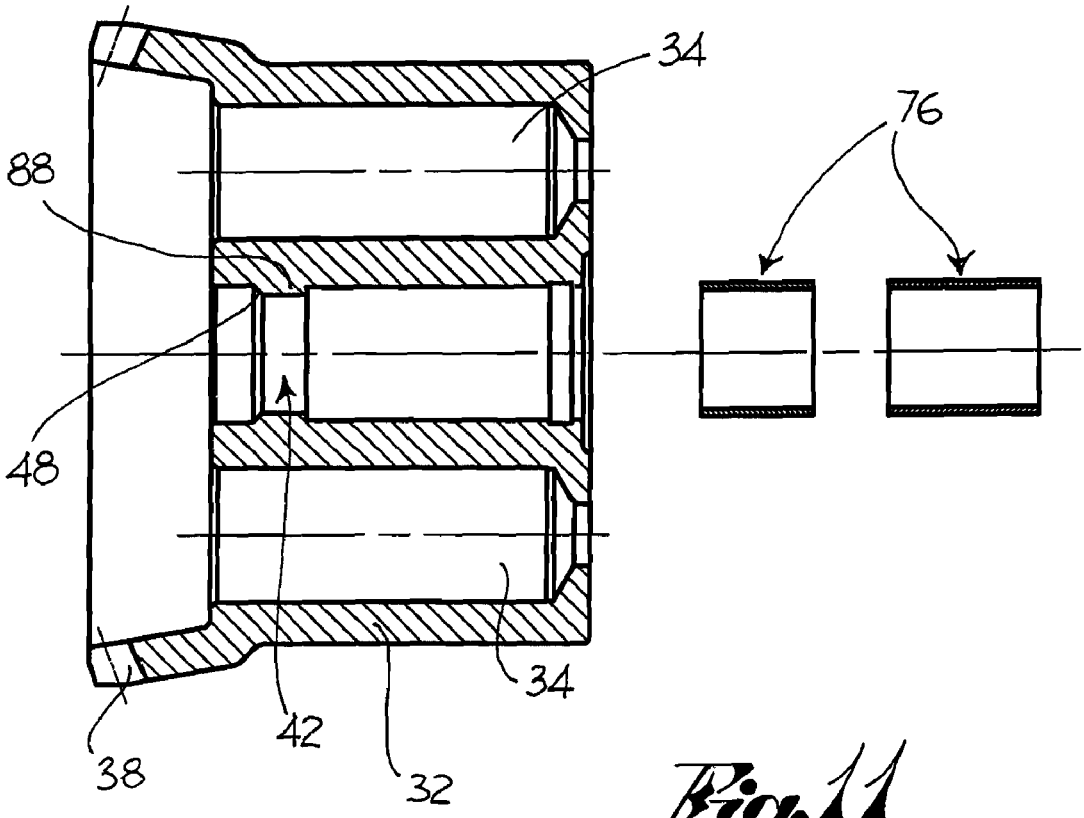

It is also possible to proceed with the step of inserting two bushes 76 into seat 42 so as to arrange bushes 76 parallel and in a series with one another (FIGS. 11-12).

The back body 54 is then assembled with the cylinder body 32. In particular, the back body 54 is provided with a connecting pin 62 integral therewith. The guiding portion 68 of pin 62 protrudes from the back body 54 which is inserted in seat 42 of the cylinder body 32; following the insertion the guiding portion 68 is on contact with the interface portion 86 of bush 76.

As can be understood from the description, the pump according to the invention allows overcoming the disadvantages of the prior art.

In particular, the bush arranged between the pin and the seat of the cylinder body ensures longer life of the pin compared to the solutions of the prior art.

In fact, the bush ensures a very low friction between the pin and the seat of the cylinder body even without lubrication.

Moreover, the bush is an element that dampens vibrations between the pin and the cylinder body.

Moreover, the relative elasticity of the bush coating limits the mechanical stresses on the pin in the event of slight shifts between the cylinder body and the pin.

In other words, thanks to the elasticity of the bush, any slight shifts due for example to heavy load conditions for the pump are not totally prevented as it happens in the prior art pumps, wherein the pin directly couples on the metal seat of the cylinder body, thus making a substantially hyperstatic constraint of the pin; rather the bush allows very slight movements that in the event of shifts prevent voltage peaks on the pin itself and ensure longer life thereof.

Moreover, the bush allows reducing vibrations and thereby the noise of the pump.

The bush therefore allows absorbing any collisions and high loads of the pump preventing the transmission of excessive stresses on the pin.

The particularly low friction coefficient ensured by the coating prevents stick-slip phenomena, with consequent twisting oscillations, and allows using the pin even in poor lubrication conditions.

The metal portion of the bush allows removing heat that generates upon the contact between the bush and the pin and thus is capable of limiting the thermal expansions of the cylinder body structure.

Thanks to the bush according to the present invention it is possible to prevent coatings of the pin with special wear-proof deposits as well as specific thermal treatments of the pin; moreover, the process roughness of the cylinder body is much less important. Thus, thanks to the bush it is possible to prevent expensive mechanical processes or thermal treatments on the pump components subject to sliding.

A man skilled in the art may make several changes and adjustments to the pumps described above in order to meet specific and incidental needs, all falling within the scope of protection defined in the following claims.

I claim:

1. Bent axis pump comprising a front body having a shaft revolving relative to a first axis of rotation operatively connected to pistons, a cylinder body associated to the front body and suitable for seating and guiding said pistons, the cylinder body being arranged along a second axis of rotation bent relative to the first axis of rotation and being integral in rotation with the shaft, a back body associated to the cylinder body and comprising a suction duct and a delivery duct for said pistons, the back body being associated to the cylinder body by the interposition of a connecting pin, integral with the back body, wherein the cylinder body comprises a seat suitable for receiving a guiding portion of said connecting pin and at least one bush integral with the seat and suitable for turnably receiving the guiding portion of the pin.

2. Pump according to claim 1, wherein said bush is inserted and locked by interference in the seat of the cylinder body.

3. Pump according to claim 1, wherein said bush comprises a metal portion in contact with an inner wall of said seat.

4. Pump according to claim 3, wherein said metal portion is bi-metallic and comprises a first contact portion, suitable for being placed directly in contact with the inner side wall of the seat and an interface portion, arranged opposite the seat of the pin, said interface portion being suitable for receiving a coating portion that receives the associable pin in contact.

5. Pump according to claim 4, wherein said first contact portions of steel and said interface portion is of porous bronze.

6. Pump according to claim 4, wherein the interface portion is made of anti-friction material suitable for receiving a guiding portion of the pin in contact.

7. Pump according to claim 4, wherein said coating portion comprises polytetrafluoroethylene (PTFE).

8. Pump according to claim 4, wherein said coating portion comprises polyphenylsulphide (PPS).

9. Pump according to claim 1, wherein said bush is axially constrained in the seat by a stopping wall facing the guiding portion of the pin.

10. Pump according to claim 1, wherein said bush is axially constrained, opposite the guiding portion of the pin, by a tapering suitable for coupling with a flaring of the seat of the cylinder body.

11. Pump according to claim 1, wherein said bush is a single piece.

12. Pump according to claim 1, comprising two bushes mechanically separate from one another and axially aligned with each other within said seat.

13. Pump according to claim 1, wherein said pin comprises at least one levelling, suitable for determining a meatus between the pin and the bush so as to allow the passage of lubricant between the pin and the bush.

14. A method of assembly of a bent axis pump according to claim 1, comprising the steps of:

inserting at least one bush in the seat of the cylinder body, so that said bush is integral in rotation with the cylinder body, and associating the cylinder body to a back body provided with a connecting pin, so as to insert a guiding portion of said pin into the seat of the cylinder body and in direct contact with an inner side wall of said at least one bush.

15. A method of assembly of a bent axis pump according to claim 14, wherein the step of inserting the bush into the seat comprises the step of applying a guiding head to the back body so as to arrange said guiding head coaxially to the cylinder body, the guiding head being provided with a guiding hole coaxial relative to the seat of the pin.

16. A method of assembly according to claim 15, comprising the step of inserting a bush in said guiding hole by a punch, forcing the axial insertion of the bush by the punch, so as to move the bush to travel end relative to the seat.

17. A method of assembly according to claim 14, comprising the step of axially constraining the bush on the side of introduction of the pin, by making a tapering of the bush.

18. A method of assembly according to claim 17, wherein said tapering is made by the axial introduction to travel end of the punch, the punch being provided with a neck suitable for enlarging the diameter of said bush.

19. A method of assembly according to claim 14, comprising the step of inserting two bushes into said seat of the pin, said bushes being arranged parallel and in a series with one another.

* * * * *